US009970204B2

(12) United States Patent
Hayman et al.

(10) Patent No.: US 9,970,204 B2
(45) **Date of Patent: *May 15, 2018**

(54) DUAL LATCHING HORIZONTAL SCAFFOLD MEMBER

(71) Applicant: Next Generation Scaffold Services, Inc., Vista, CA (US)

(72) Inventors: Yates W. Hayman, Walker, LA (US); Stephen Howard Thacker, The Woodlands, TX (US); Johnny Curtis, Denham Springs, LA (US)

(73) Assignee: Next Generation Scaffold Services, Inc., Vista, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/078,390

(22) Filed: Mar. 23, 2016

(65) Prior Publication Data

US 2016/0201341 A1 Jul. 14, 2016

Related U.S. Application Data

(63) Continuation of application No. 14/310,995, filed on Jun. 20, 2014, now Pat. No. 9,303,417, which is a continuation-in-part of application No. 13/349,482, filed on Jan. 12, 2012, now abandoned, and a continuation-in-part of application No. 13/355,645, filed on Jan. 23, 2012, now Pat. No. 8,881,869.

(Continued)

(51) Int. Cl.
*E04G 7/32* (2006.01)

(52) U.S. Cl.
CPC ..... *E04G 7/32* (2013.01)

(58) Field of Classification Search
CPC ..... E04G 7/37
See application file for complete search history.

(56) References Cited

U.S. PATENT DOCUMENTS 2,229,909 A 1/1941 Wread
2,561,938 A 7/1951 Meng
(Continued)

FOREIGN PATENT DOCUMENTS

FR 2083214 12/1971
FR 00252771 A1 12/1983
(Continued)

OTHER PUBLICATIONS

Extended European Search Report for Application EP 12739463.3 by the European Patent Office dated May 27, 2014.

(Continued)

*Primary Examiner* — Alvin C Chin-Shue
(74) *Attorney, Agent, or Firm* — Jones Walker LLP

(57) ABSTRACT

One embodiment of the invention is a horizontal scaffold member having a primary end connector and a secondary end connector. Each end connector is configured to couple to a cup on a vertical scaffold member. Each end connector includes a wedge assembly having a handle and a wedge, movable with respect to the wedge head to a latched and unlatched position. The primary wedge assembly is connected to the secondary wedge assembly by a cable, and configured so that moving the primary wedge assembly to an unlatched position also moves the secondary wedge assembly to an unlatched position.

11 Claims, 12 Drawing Sheets

Related U.S. Application Data

(60) Provisional application No. 61/461,938, filed on Jan. 25, 2011.

(56) References Cited

U.S. PATENT DOCUMENTS

| | | | |
|---|---|---|---|
| 2,615,350 | A | 10/1952 | Wahlberg |
| 3,323,271 | A | 6/1967 | Collins |
| 4,273,463 | A | 6/1981 | Dobersch |
| 4,369,859 | A | 10/1983 | Smits |
| 4,445,307 | A | 5/1984 | Puccinelli et al. |
| 4,840,513 | A | 6/1989 | Hackett |
| 5,028,164 | A | 7/1991 | Williams |
| 5,078,532 | A | 1/1992 | Williams |
| 5,605,204 | A | 2/1997 | Ausejo |
| 5,615,966 | A | 4/1997 | Jarvis et al. |
| 5,961,240 | A | 10/1999 | Bobrovniczky |
| 6,027,276 | A | 2/2000 | Schworer |
| 6,017,067 | A | 3/2000 | Yoneyama et al. |
| 6,354,646 | B1 | 3/2002 | McManus et al. |
| 6,375,405 | B1 | 4/2002 | Kallevig |
| 6,572,170 | B2 | 6/2003 | McManus et al. |
| 6,669,246 | B2 | 12/2003 | Cowper |
| 7,036,853 | B2 | 5/2006 | Smock et al. |
| 7,048,093 | B2 | 5/2006 | Wallthier |
| 7,971,686 | B1 | 7/2011 | Hayman |
| 8,206,052 | B1 | 6/2012 | Hayman |
| 8,303,207 | B2 | 11/2012 | Thacker |
| 8,336,928 | B2 | 12/2012 | Okunaka et al. |
| 8,393,439 | B2 | 3/2013 | Thacker |
| 2009/0052980 | A1 * | 2/2009 | Williams ..... E04G 7/307 403/33 |
| 2009/0301815 | A1 | 12/2009 | Rogers |
| 2011/0180350 | A1 | 7/2011 | Thacker |
| 2012/0186911 | A1 | 7/2012 | Thacker et al. |
| 2013/0142564 | A1 | 6/2013 | Thacker |

FOREIGN PATENT DOCUMENTS

| | | | |
|---|---|---|---|
| FR | 2752593 | A3 | 2/1998 |
| JP | 2008002117 | A | 1/2008 |
| WO | 2010136044 | A1 | 12/2010 |
| WO | WO 2010136044 | A1 * | 12/2010 ..... E04G 1/04 |
| WO | 2011008094 | A1 | 1/2011 |
| WO | 2011094351 | A2 | 8/2011 |
| WO | 2012102881 | A1 | 8/2012 |

OTHER PUBLICATIONS

U.S. Appl. No. 13/349,482, filed Jan. 12, 2012, published as US 2012-0186911 A1 on Jul. 26, 2012, Final Office Action dated Feb. 18, 2014, 17 pages.

* cited by examiner

PRIMARY LATCH (P)

SECONDARY LATCH (S)

DUAL LATCHING HORIZONTAL SCAFFOLD MEMBER

CROSS REFERENCE TO RELATED APPLICATIONS

This application is a continuation of U.S. application Ser. No. 14/310,995, filed on Jun. 20, 2014, which application was a continuation-in-part of U.S. application Ser. No. 13/349,482, filed on Jan. 12, 2012, and which application was a continuation-in-part of U.S. application Ser. No. 13/355,645, filed on Jan. 23, 2012, now U.S. Pat. No. 8,881,869, both of which claimed the priority benefit of U.S. Provisional Application No. 61/461,938, filed on Jan. 25, 2011. Applicant claims the priority benefit of all of these applications, and all applications are hereby incorporated by reference herein in their entirety.

FIELD OF THE INVENTION

This invention relates to modular scaffolding systems that are erected as impermanent structures to support platforms, and in particular to improve horizontal scaffold members used in these modular scaffold systems. Scaffolding is used, inter alia, in the industrial, commercial, petro-chemical, power source, general industry and residential construction markets.

BACKGROUND

In 2008, the Bureau of Labor Statistics' Census of Fatal Occupational Injuries (CFOI) reported 88 fatalities occurred in the year 2007 related to the use of scaffolds and many more injuries. Twenty-seven percent (27%) of the fatalities and many of the injuries involved falls off of welded frame scaffolds over 25 feet high during the installation of the scaffolds. Safety officials recommend that scaffolding falls be pre-empted through the use of sequential erection techniques. This involves installing guardrails and standards at regular distances along the scaffold such that the exposed platform edge is not greater than a bay length between intervals. The use of safety harnesses or belts tethered to guardrails during the erection process is also a recommended safety practice. However, the use of safety harnesses to deter fall injuries during scaffold erection is quite limited due to the components used in conventional scaffolds. The nature and design of conventional scaffold components, as described herein, disadvantageously do not allow the effective use of safety harnesses during the erection process.

Tube and coupler scaffolds are so-named because they are built from tubing connected by coupling devices. Due to their strength, they are frequently used where heavy loads need to be carried, or where multiple platforms must reach several stories high. Components of scaffolds include vertical standards having coupling rings or rosettes, horizontal components such as ledgers and guardrails coupled to the coupling rings or rosettes, footings, decks/platforms and diagonal braces. Their versatility, which enables them to be assembled in multiple directions in a variety of settings, also makes them difficult to build correctly.

Conventional scaffolding systems have various components. FIG. 1 illustrates a supported scaffold 100 consisting of one or more platforms supported by rigid support members such as poles, tubes, beams, brackets, posts, frames and the like. More specifically, the supported scaffold 100 includes the following components: deck/platform 101, horizontal members, or ledgers 102, and vertical standards 103. Additional components include diagonal braces to increase the stiffness and rigidity of the scaffold 100.

FIG. 2 is an illustration of a vertical standard 103. Vertical standards are typically cylindrical tubes 200 comprised of hot-dip galvanized steel or aluminum. A collar with an expanded or reduced diameter or a spigot at either or both ends of the vertical standard facilitates the joining of vertical standards from end to end. Rosettes 201 are positioned and then welded or otherwise attached along the tubes providing connections for horizontal members and diagonal braces. The vertical standard can have from one to 8 or more rosettes placed along the tubing using a predetermined spacing between rosettes, for example, about every 20 inches.

FIG. 3 illustrates a ledger 102. A ledger is a horizontal member that serves as both a guardrail and bracing element. The ledger 102 is comprised of tubing 300, heads 301 and wedges 302. Ledgers 102 are available in different lengths, depending on the scaffolding bay length, deck type and load. It is the conventional manner in which these ledgers are coupled to vertical standards that contribute to scaffolding falls as further described herein. Once the tubing on a level is installed, decks or platforms 101 made of, e.g., hot-dip galvanized steel, aluminum, wood or an aluminum frame with plywood board are installed to allow workers to traverse the scaffold 100 and install the guardrails (e.g., ledgers 102).

Referring now to FIG. 4, wedge 302 is shown being hammered into the slot or gap of head 301 at the end of a ledger 102 so as to couple it to the rosette 201 of the vertical standard 200. This must be done by a worker first at the proximate end of the ledger 102 and then at the distal end of the ledger 102. However, as the proximate end of the ledger 102 is being coupled to the vertical standard using the wedge 302, the distal end of the ledger 102 is free and uncoupled, that is, until the worker can traverse the platform to the distal end of the ledger 102 and hammer in a wedge 302 at the distal end. During this time, the distal end of the ledger 102 remains uncoupled from the vertical standard. Hence, if the installer is harnessed to the ledger 102 and the scaffold tilts toward the uncoupled, distal end, the installer may tumble down the platform and the safety harness will exit the uncoupled end of the ledger, providing no measure of safety to the installer.

A conventional rosette 500, as seen in FIG. 10, has a central aperture 503 to receive the vertical tubing, four small openings 501A-D to facilitate right-angled connections and four larger openings 502 A-D to facilitate connections at any angles. Typically, a vertically and horizontally slotted head 504 coupled to the end of a ledger is positioned with respect to the rosette 500 such that the horizontal slot of the head 504 is positioned over and under the rosette 500 and the vertical slot of the head is aligned with an aperture of the rosette 500. A wedge 302 is then hammered into the vertical slot (or gap) to couple the ledger 102 via the head 504 to the vertical standard 103 via the rosette 500 using, inter alia, frictional force. Note that, disadvantageously, until the wedge 302 is installed, there is significant play between the rosette 500 and head of a horizontal member giving rise to safety concerns. Furthermore, once installed, wedges often work free when workers traverse the platform. When these wedges work free, the scaffold can become unstable and collapse. Further, even if the scaffold does not collapse, steel wedges, which, as seen in the Figure, are not integrated into the head or the ledger, can fall from the scaffold injuring workers below.

Another type of modular scaffold joint uses an end connector positioned on the end of a horizontal member, where the end connector has a lip or hook section that is designed to engage or rest on a corresponding vertical connector cup or annular ring positioned on a vertical scaffold member. One such joint is disclosed in U.S. Pat. No. 4,445,307 (the Safway system scaffold) which discloses a connector 3000 positioned on a horizontal scaffold member 1001, where the connector has two vertically spaced hook sections 3003. An example of the Safway joint is shown in FIG. 5. These hook sections couple with two vertically spaced upstanding cup ring members 3102 located on the vertical scaffold member 3100. Each cup member has a surrounding annular lip 3103 to which the hook members on a horizontal member end connector engage. To lock the joint in place, the connector includes a wedge 3005 that is driven (generally by a hammer) into position below or on the underside of the lower cup member, thereby wedging the cup 302 against the end connector hood section 3003, latching the horizontal member to the vertical member. As used herein, "latching" refers to the action of engaging a horizontal member to a vertical member, where the action of latching resists dislodgement of the horizontal member from the vertical member from an upwardly directed force.

Another cup type of latching connector is disclosed in U.S. Pat. Nos. 5,078,532 and 5,028,164 and in U.S. application Ser. No. 12/489,166, all hereby incorporated by reference (the Excel system scaffold). One embodiment of an Excel-type end connector is shown in FIG. 6. These patents and applications also have an end connector 2000 positioned on a horizontal scaffold member 2001, where the connector has two vertically spaced hooked sections 2003 that couple with two vertically spaced upstanding cup members 2102 located on the vertical scaffold member 2100. Each cup member 2102 has a terminating edge or lip section 2103 that is used to engage the hook sections 2003 on the horizontal end connector 2000. In this device, the hooked sections 2003 engage the top edge of the cup 2103, and a pivoting member or latch 2003, positioned on the horizontal end connector, is pivoted into position below the top cup member. The latch member 2003 has a distal end extending beyond the housing toward the vertical member, shaped to allow for placement of the distal end beneath a cup 2102 positioned on a vertical scaffold member. Hence, when latched, the cup 2102 is trapped between the hook engagement sections 2003 of the connector housing and the distal end of the latch member 2003. The latch pivots on a pivot pin, and can be spring loaded to bias the latch into a locking or actuated position. The latch is operated by trigger or handle 2004. Single cup embodiments are also possible, such as shown in U.S. Pat. No. 7,048,093 (hereby incorporated by reference).

What is desired is a scaffolding apparatus that is configured to couple each end of a horizontal scaffold member (also referred to herein as a horizontal, or horizontal member or a ledger) to a vertical standard (also referred to herein as a vertical member, vertical or vertical scaffold member), where the vertical member has an annular member, such as a cup or a rosette, and an assembly mechanism that allows a single installer to insert and lock pivoting wedges at both ends of the horizontal member, and to release both ends substantially simultaneously if using the primary trigger, or to only release one end if using the secondary trigger.

SUMMARY

One embodiment of the invention is a horizontal scaffold member having a primary end connector and a secondary end connector. Each end connector is configured to couple to an annular member on a vertical scaffold member. Each end connector includes a wedge assembly having a handle and a wedge, movable with respect to the wedge head to a latched and unlatched position. The primary wedge assembly is connected to the secondary wedge assembly by a cable, and configured so that moving the primary wedge assembly to a unlatched position also moves the secondary wedge assembly to an unlatched position.

DESCRIPTION OF THE DRAWINGS

A more complete understanding of the invention may be obtained by reference to the following Detailed Description, when taken in conjunction with the accompanying Drawings, wherein.

DETAILED DESCRIPTION

As noted herein, components of the invention include at least one horizontal member which horizontal member preferably has a wedge head at each end thereof. The wedge head includes an engagement portion that is designed to couple to an annular ring or member on a vertical scaffold member (such as a cup or rosette) and a portion (the wedge) when positioned adjacent to an annular ring (generally the underside) on a vertical scaffold member latches the horizontal member to the vertical member. The horizontal member is configured to engage and be supported by vertical horizontals at each end of the horizontal member. Each vertical member has at least one annular ring affixed in coaxial alignment thereon, such as cup or rosette. In the cup embodiment, the cup having an upstanding edge, lip or engagement portion for receiving an engaging hook, projecting finger, tooth or cutout located on the wedge head. The wedge head may also be referred to as a connector or end connector. The embodiments described herein show a wedge head having two engagement portions (or hook sections) formed in the sidewalls of the wedge head, each configured or shaped to engage corresponding lip sections on the cups on a vertical member. However, the invention is not limited to embodiments having two or more engagement sections, and can be utilized on scaffold systems where the wedge head is connectable to a single annular ring (such as a single cup or rosette). The embodiment using cups will be described first.

Figure 5:
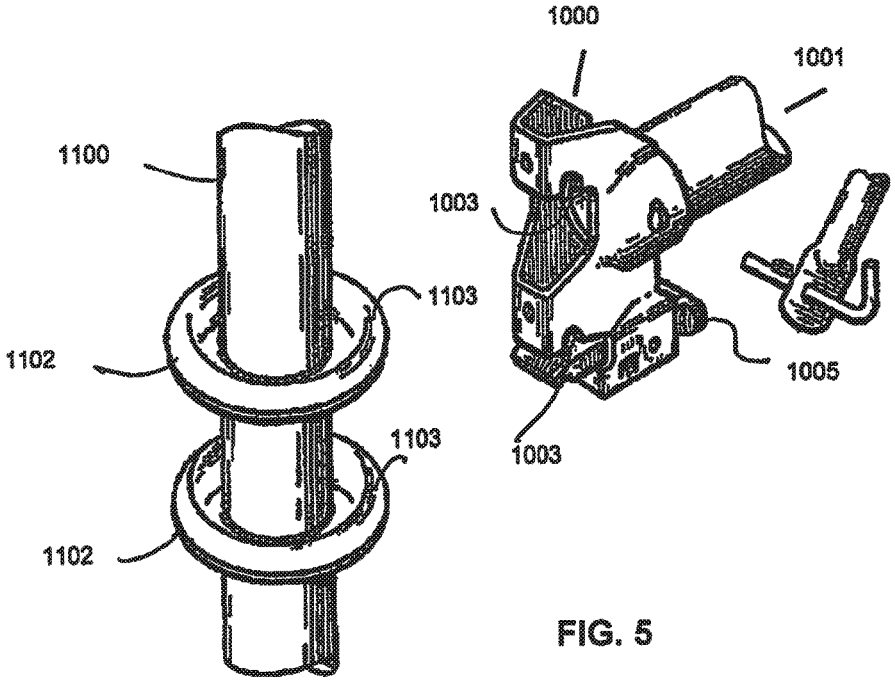
FIG. 5 is a perspective view of a prior art Safway-type end connector.
Figure 6:
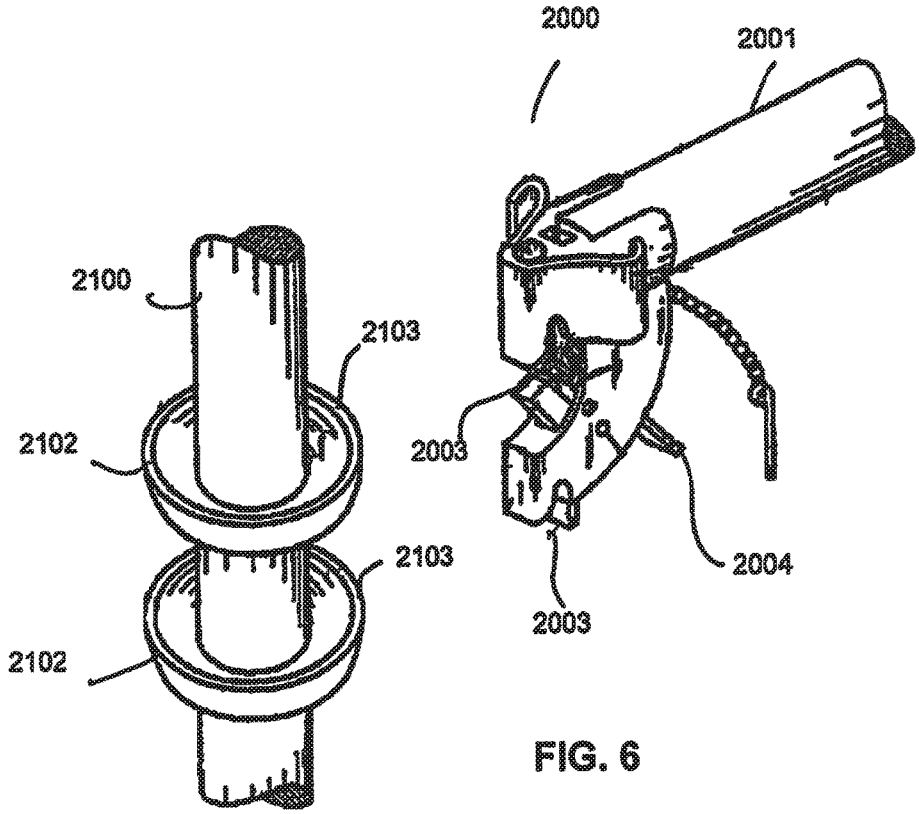
FIG. 6 is a perspective view of a prior art Excel-type end connector.

Generally, a vertical or horizontal member is a hollow tube constructed of metal, preferably galvanized metal of about ⅛ inch thickness. The vertical member will have a series of cups attached thereon at spaced apart locations. Each cup has an upper side and an underside, with an upstanding edge or lip section (also referred to as an engagement section) on the upper side of the cup. See generally, FIGS. 5 and 6. Each horizontal member has two ends, with a wedge head located on each end. The wedge head can be a crimped metal tube having an interior section, with suitable openings to accommodate the wedge assembly, where the crimped tube is attached at substantially right angles to the long axis of the horizontal tube (such as in the Safway design), or may compromise two substantially parallel sidewalls (suitably joined together for rigidity) and having an interior space therebetween, and also joined to the horizontal tube at substantially right angles to the long axis of the horizontal member (such as in the Excel design Ser. No. 12/489,166). As indicated, the construction features of the wedge head can vary.

Figure 7:
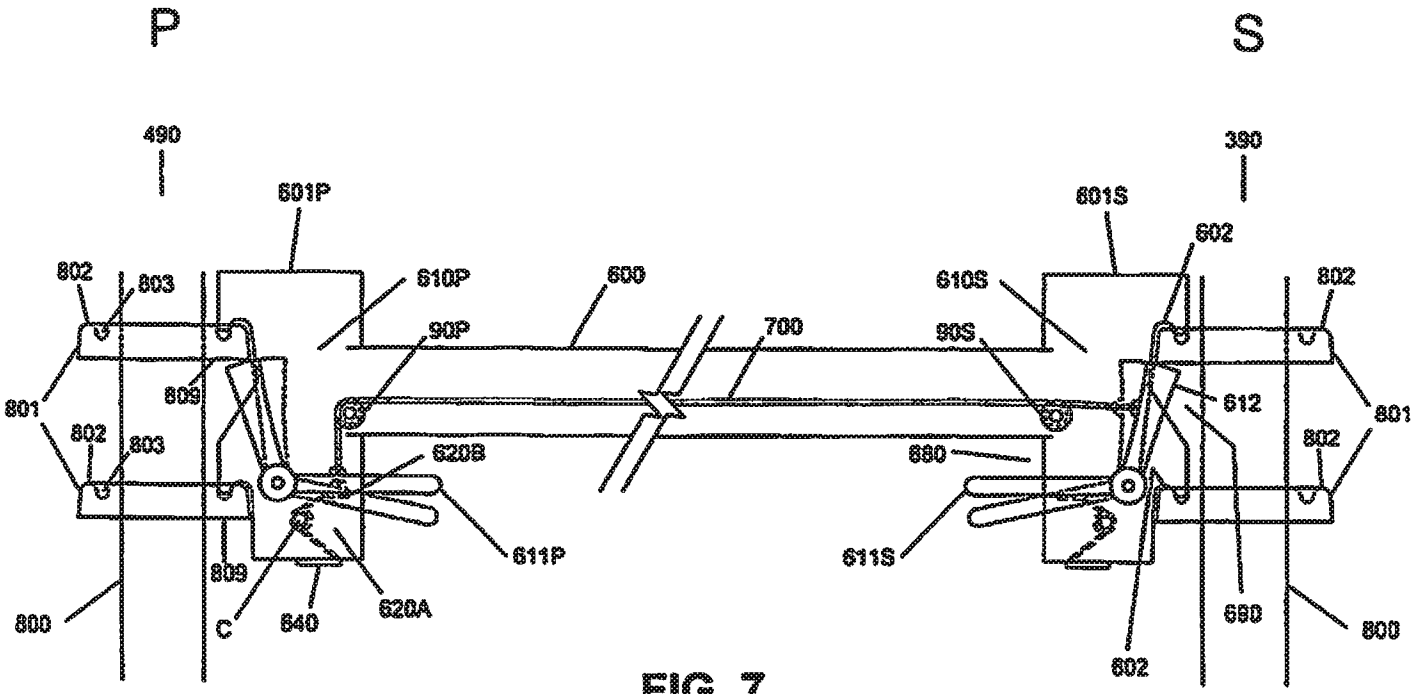
FIG. 7 is a side partial cutaway view of one embodiment of the invention in a Safway-type end connector.

One embodiment proposed for a Safway-type cup and end connector is shown in cutaway view of FIG. 7. Shown are two vertical members 800, coupled to a horizontal member 600. Each vertical member 800 has two cups 801. Each cup has an upwardly raised annular lip portion 802 (generally an annular raised rolled lip with an interior surrounding depression), and an underside 809 opposite the lip portion. Horizontal scaffold member 600 has a wedge head 601 positioned on each end of the horizontal tube, a primary wedge head 601*p* or primary end connector 490, and a secondary wedge head 601*s* or secondary end connector 390 (where the "p" represents primary and the "s" represents secondary—in most instances only a single number, e.g. "601" will be used as the two components are substantially similar in the embodiments shown, and where clarity is required, the "p" and "s" designations will be utilized). Generally, the construction of each wedge head will be substantially similar, with the exception of the cable connection discussed later. The wedge heads 601*p*, 601*s* shown are crimped hollow tubes coupled to the opposing ends of the horizontal member 600, with the interior of the horizontal member 600 communicating with the interior of the wedge heads 601. Each wedge head 601 has a hook portion 602 adapted to engage the lip section 802 of the cups 800. Contained in each wedge head 601 is a wedge head assembly 610, generally comprising a handle portion 611 (sometimes referred to as a trigger), and a wedge portion 612 connected to or integral with the handle portion 611. As shown the handle and wedge are integral, and moveable within the interior of the wedge head (such as pivotable as shown, or slidable (not shown)). Wedge head 601 has a front opening 690 facing the vertical member through which the wedge 612 can extend, and a rear opening 680 through which the handle 611 can extend.

Each wedge assembly is biased so that wedge 612 is positioned in a closed or latched position by using a biasing means, such as a spring 620. Closed or latched means that the wedge 612, when the horizontal member is coupled to a vertical member, will be positioned adjacent or proximate to the underside 809 of a cup, thereby coupling the wedge head 601 to the cup 801 in a fashion to resist removal of the wedge head by an upward force. The wedge, when latched, may or may not make contact with the underside of the cup. It is not necessary that the wedge be in tight engagement with the underside of the cup, or even touch the cup underside. In some embodiments, it is preferred that the connection be loose, as the connection functions to trap the cup between the wedge and hook engagement portion on the wedge head. Biasing means can be a spring such as a bar or wire spring, coil or other suitable biasing means, and will be referred to as a spring in the following. The wedge assembly is considered "open" or "unlatched" when the wedge 612 is positioned away or distal from the underside of a cup 801, (in relationship to the unlatched position) so that when an upward lifting force is applied to a wedge head, the wedge head is detachable or separable from the cup (as the wedge 612 is now not in a blocking position adjacent the underside of the cup).

As shown, spring 620 has two ends, 620A and 620B, and a pivot point C. End 620A bears against a bottom plate 640 on wedge head 601, while end 620B bears against handle 611. A cable 700 (rope, chain or other flexible connector, but generally not substantially stretchable lengthwise, with a preferred embodiment being a ⅛ inch wire rope) runs through the hollow interior of the horizontal member 600. One end of cable 700 enters the interior of the primary wedge head 601*p*, and slides over a member 90*p*, such as a pin, pulley or other member, which may be rotatable in the wedge head interior. The cable 700 then extends downwardly and is attached to or is connected to the wedge assembly at the handle 611*p*. The other end of the cable 700 enters the interior of the secondary wedge head 601*s* (or secondary end connector 390), and slides over member 90*s* and then is connected to or attached to the wedge assembly at wedge 612. The members 90*a* and 90B may be dispensed with, but they are preferred to keep the cable 700 from binding in the respective wedge head 601.

As described, each end of the horizontal member 600 can be connected to a vertical by "snapping" the horizontal wedge head assembly into place on the cup of a vertical. In this action, the horizontal member is positioned with the top hook portion 602 clearing the raised lip 802 of a cup (the bottom hook portion will also be positioned slightly above the raised lip of the lower cup). As the wedge head 601 is moved toward the vertical, the wedge 612 will contact the side of the cup 801 and be moved to the open or unlaced position, as the spring 620 compresses. Once the hook sections 602 on the wedge head 601 is positioned directly above the raised lip 802, the wedge head 601 can be lowered until the lip sections 802 of the upper and lower cups contacts the respective upper and lower hook engagement portions 602. At this point, wedge 612 will pivot forward by spring 620 until a portion of the wedge 612 is positioned below a cup 801, thereby latching the horizontal to the respective vertical. Also, each wedge may be manually coupled to a vertical by an operator manually depressing handle 611, and then coupling the wedge head 601 to the vertical members cups, and then releasing handle 611.

As shown, the end of the cable in the primary connector or primary wedge head 601*p* is connected to the handle 611*p* in that wedge head; while the other end of the cable 700 is connected to the wedge 612*s* in secondary connector. As a result, as handle 601*p* in the primary end connector 490 is depressed and pivoted downwardly (thereby unlatching the wedge 612*p* head in the primary connector), the cable 700 follows the handle 611*p* downwardly. As a result, the wedge 612*s* in the secondary connector is also pivoted or pulled away from the corresponding vertical member, and the connected handle 611*s* compresses the respective spring 620*s*, thereby pivoting the secondary wedge assembly, against the spring bias, to the unlatched position. In this fashion, a single operator may thereby unlatch both wedge heads by the operation of only the primary handle 611*p*.

However, if the operator operates the handle 611*s* on the secondary end connector 390 to open or unlatch the wedge 612*s* by depressing the handle 611*s* and pivoting the handle downwardly, such action does not open or unlatch the wedge 612*p* on the primary end connector 490. This occurs due to the different attachment points of the cable 700 to the primary and secondary wedge assemblies. The act of operating the secondary connector handle 611*s* will not result in the spring 620*p* in the primary wedge head being compressed as there is no force exerted on the primary spring in response to operation of the handle 611*s* in the secondary connector. Preferably, the two handles 611*p* and 611*s* should be shaped differently (not shown) so that an operator may easily distinguish the primary end connector from the secondary end connector.

Figure 8A:
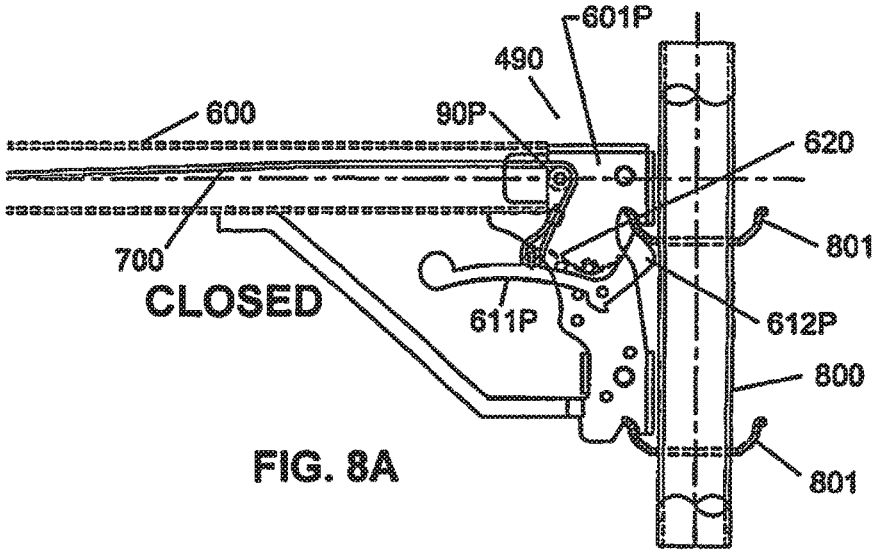
FIG. 8A is a side partial cutaway view of one embodiment of the invention primary end connector in the closed position.
Figure 8B:
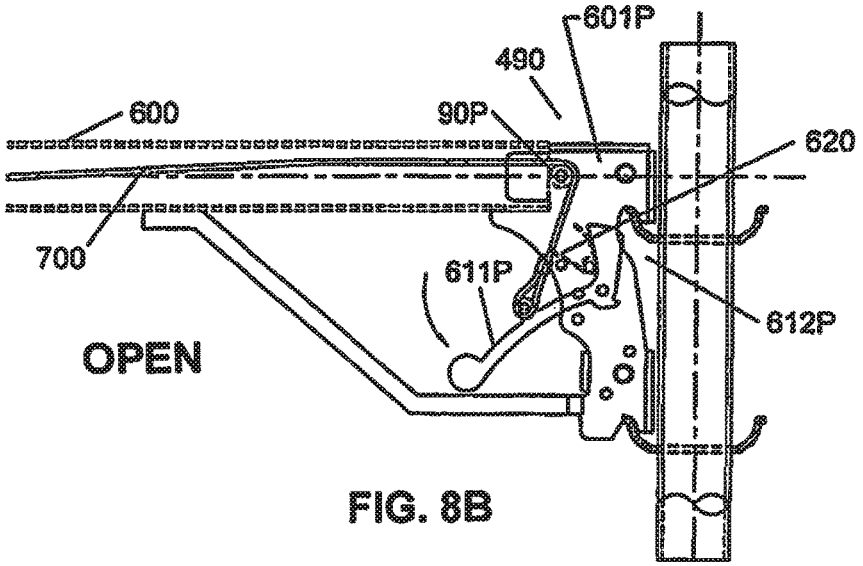
FIG. 8B is a side partial cutaway view of one embodiment of the invention primary end connector in the open position.
Figure 9A:
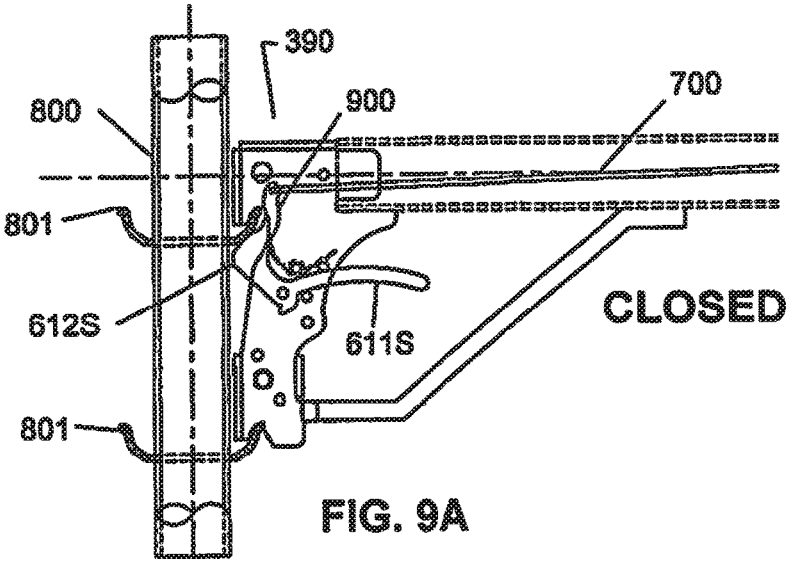
FIG. 9A is a side partial cutaway view of one embodiment of the invention secondary end connector in the closed position.
Figure 9B:
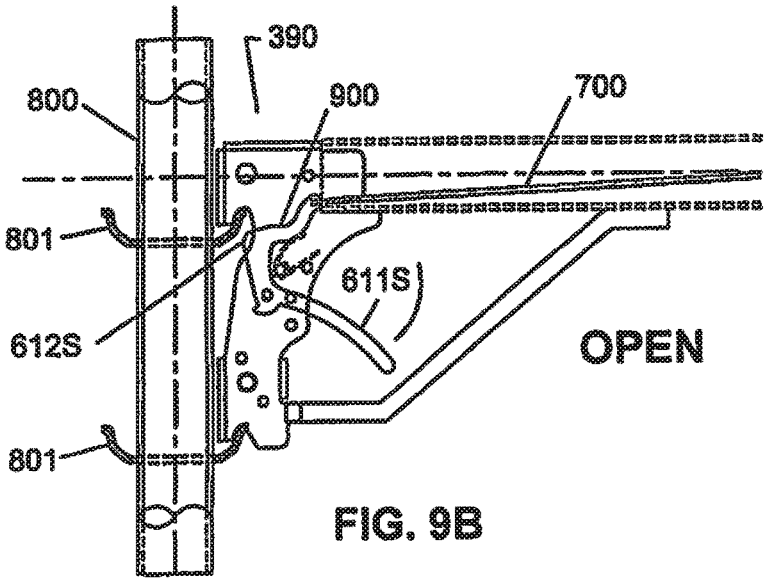
FIG. 9B is a side partial cutaway view of one embodiment of the invention secondary end connector in the open position.

Another embodiment of the invention for use with an Excel-type connector and cup is shown in FIGS. 8 and 9. FIGS. 8A and 8B shows an end connector designed to accommodate an Excel-type cup having an upstanding lip that is the edge of the cup. Construction details of this wedge head and the cups that correspond are contained in U.S. Pat. Nos. 5,078,532 and 5,028,164 and in U.S. application Ser. No. 12/489,166. The primary differences of this embodiment from that shown in FIG. 7, are: (1) the location of the spring 620—in this embodiment, one end of the spring 620A bears against a pin in the interior of the wedge head, and the other end of the spring 620B bears against the wedge 612 (as opposed to the handle in the embodiment of FIG. 8); (2) the cable 700 connects on the secondary wedge assembly to a rear projecting extension 900 shown integrally attached to the wedge 612*s* (shown in FIGS. 9A and 9B, the rear extension allows the cable attachment point to be raised on the wedge assembly); and (3) the primary wedge 612*p* and secondary wedge 612*s* are not shaped identically as only the secondary wedge, as shown, has a rearward extension 900. However, both primary and secondary wedges can have the rearward extension. Also, as shown the primary and secondary handles 611*p* and 611*s* are shaped differently to allow an operator to easily tell them apart.

In each embodiment, operation of the primary latch or connector exerts a force on the secondary end connector, transmitted through the increased cable tension cable—as the cable is drawn downward in the primary connector, the other end of the cable is drawn toward the primary end connector by the tension in the cable. As the wedge is connected to the cable, the wedge is thus drawn to the unlatched position. Contra wise, as the secondary latch is dawn downward to unlatch the secondary connector, the cable's tension is lessened on the primary connector, and hence no forced is exerted to counterbalance the tension of the spring in the primary end connector.

To install, the cable (such as a ⅛" wire rope) is installed by first attaching it to the rearward extension 900 of the wedge with a crimp-able wire rope sleeve. The wedge assembly is then installed in the interior of the secondary wedge head (e.g. the trigger (handle)), spring and bolt to the secondary end connector. At this point, the wire rope cable is pushed through the secondary wedge head and into the horizontal tubing member towards the primary end connector. The cable is captured at the primary wedge head and pulled through the primary wedge head. The primary wedge assembly and spring and sleeve bushing are joined to the primary wedge head. The primary handle (trigger) is then rotated downwardly to the unlatched position, then one attaches the wire rope cable to the primary handle or trigger using a crimpable wire rope sleeve. The connector can also be used with rosettes as described in the provisional application.

Figure 1:
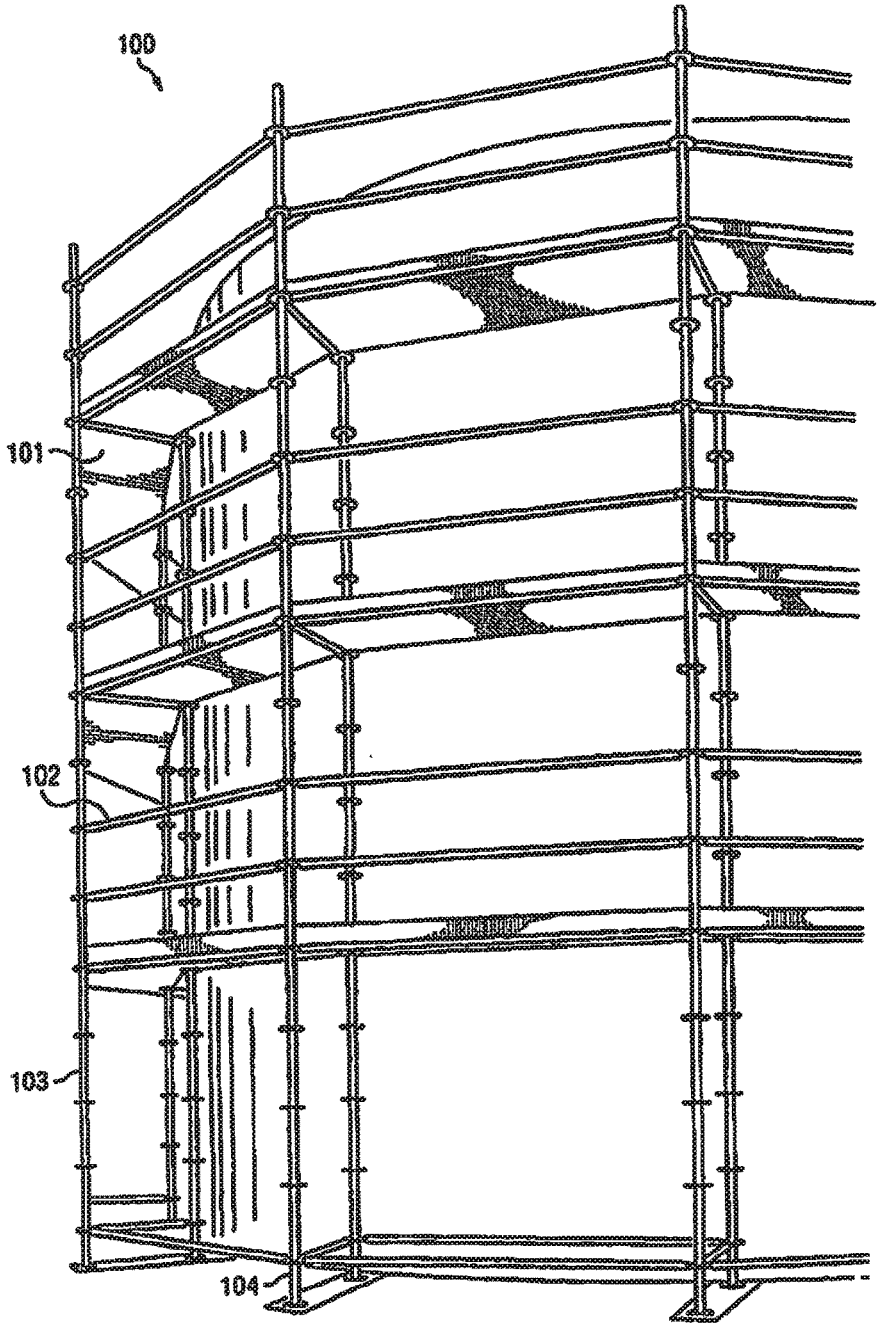
FIG. 1 illustrates a scaffold structure.
Figure 2:
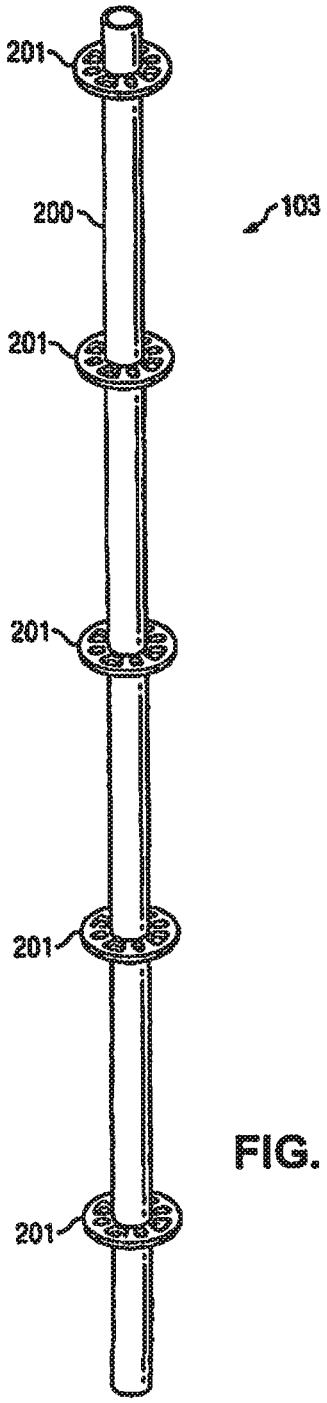
FIG. 2 illustrates a vertical standard.
Figure 3:
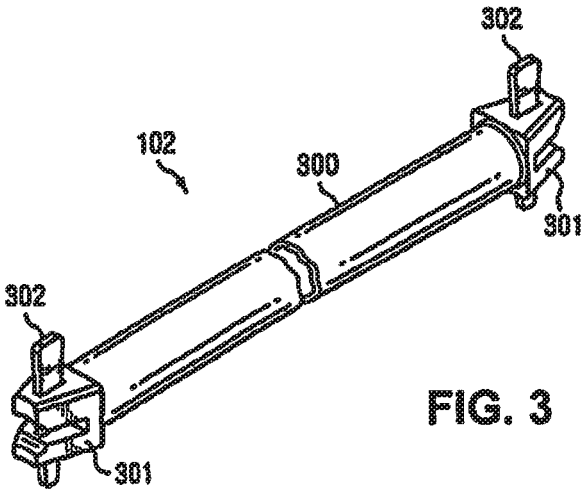
FIG. 3 illustrates a conventional ledger with unsecured wedges.
Figure 4:
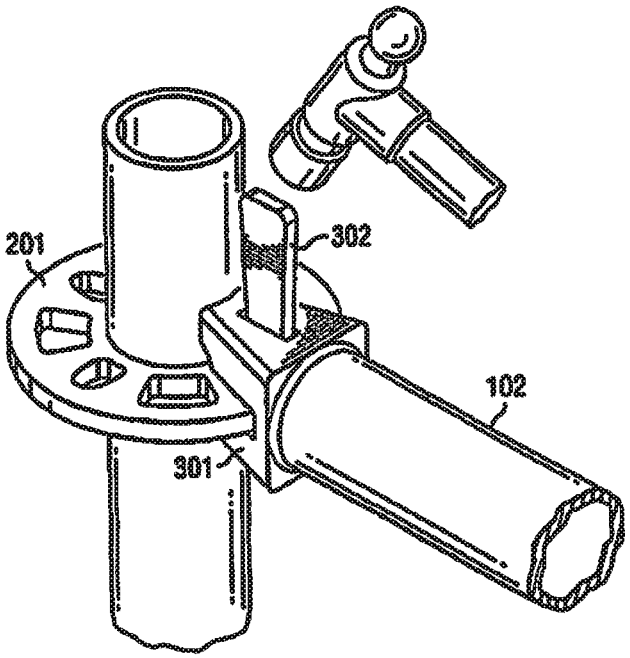
FIG. 4 illustrates the installation of an unsecured wedge into a conventional ledger head.
Figure 10:
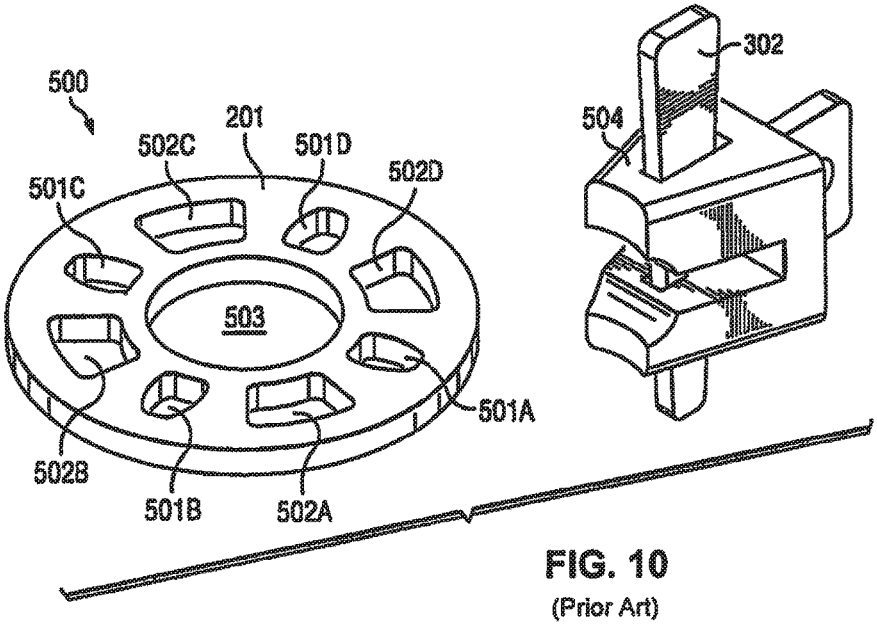
FIG. 10 (Prior Art)
FIG. 10 is a perspective view of a conventional rosette.
Figure 11:
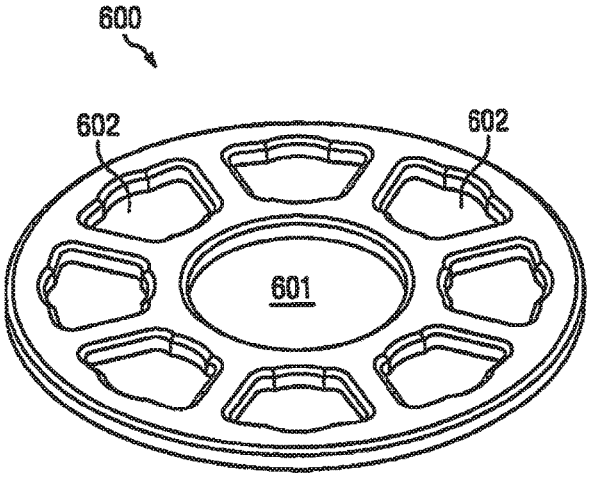
FIG. 11 is a perspective view of one embodiment of a rosette

In another embodiment of the invention, the end connector is to be coupled to a rosette type annular ring located on a vertical, similar to that shown in FIG. 4, 10 or 11. The embodiment includes a horizontal member with a wedge head at each end thereof, alone or in combination with at least one vertical member including at least one rosette (an annular member) affixed in coaxial alignment thereon, the rosette having apertures for receiving mating engagement portions (prongs, finger or a tooth) of an wedge head (which may be a separate component of the horizontal member, or an integrated portion at the end of the horizontal member). A wedge assembly is associated with the wedge head and horizontal member, the wedge assembly having a separate handle and wedge portion or integrated handle and wedge portion, the wedge assembly at an end of the horizontal member being responsively coupled to a wedge assembly at the other end of a horizontal member using a cable, wire (preferably) or other transmission means. Each wedge head may further include one or a plurality of prongs, teeth, or fingers dimensioned to fit within one aperture or opening formed in the rosette. The wedge head has an opening or slot through which the wedge portion extends wholly or partially out of the wedge head to lock or latch the wedge head when activated by a handle, operable to couple the horizontal member to the rosette An aspect of the invention is a joint for use in coupling a horizontal member to a vertical member having a rosette with a set of radially arranged cut-outs, a horizontal member further comprising a hollow tube having contained therein a wedge assembly, the wedge assembly having a wedge portion at the end thereof which is wholly or partially extendable and retractable into a hollow tube or cavity of a wedge head and/or horizontal member. The wedge head, located at the end of the horizontal member, has mating elements corresponding to the radially arranged cut-outs of the rosette. When the mating or engaging elements of the wedge head or the horizontal member are received in one of the radially arranged cut-outs of the rosette, and the wedge assembly is actuated, such as by use of a handle or spring bias) causes the wedge portion to be located adjacent to the underside of the annular ring or rosette, firmly coupling the wedge head or horizontal member to the rosette.

Referring now to FIG. 11, the top view of one embodiment of a rosette 1600 of the invention is shown. An embodiment of rosette 1600 is circular in shape and has a breadth or extent. Such breadth or extent may be any measure appropriate to allow the wedge head to engage the rosette 1600 as more fully described herein. Rosette 1600 has a central aperture 1601 or cut-out in a substantially circular shape dimensioned to receive the vertical tubing of the vertical member. In another aspect, such central aperture or cut-out may be any shape that corresponds to the cross-sectional shape of a vertical member. Once placed on the vertical tubing, rosette 1600 can thus be welded or otherwise attached in a co-axial alignment with the vertical tubing of the vertical member. A plurality of rosettes can thus be positioned and affixed along the length of the vertical tubing. Between the outer circumference of rosette 1600 and the outer circumference of the central aperture 1601 are a plurality of radially arranged cut-outs 1602 for receiving prongs of at least one wedge head as further described herein. The grid arrangement of the radially arranged cut-outs 1602 allow for multiple arrangements of horizontal members to the vertical member via rosette 1600. As seen in FIG. 11, eight (8) radially arranged cut-outs are shown, although a different number of radially arranged cut-outs can be arranged on rosette 1600. In an embodiment of the invention, the radially arranged cut-outs 1602 generally comprise trapezoids with inner and outer edges having circular arcs of concentric circles of different radii. The intersections of the line segments and arcs can be filleted, comprising a concave easing of the interior corners to reduce stress concentration. On a portion of, and further cut out from, the inner and outer edges of such trapezoids are arc shaped notches comprising a portion of a circle centered on the trapezoid. The edges of intersection of each of the upper and lower surfaces of the rosette with the vertical, interior walls of the rosette can be rounded, beveled or chamfered. The radially arranged cut-outs 1602 are dimensioned to receive vertical prongs, teeth or fingers of the wedge head. Stated otherwise, the vertical member includes at least one rosette having a set of radially arranged cut-outs, the vertical member affixed in coaxial alignment with the rosette, the cut-outs to receive the wedge head having mating elements corresponding to the radially arranged cut-outs of the rosette, wherein, when the mating elements of the wedge head are received in the radially arranged cut-outs of the rosette, the wedge assembly, when actuated, causes the wedge portion to couple the horizontal member to the rosette, such as by placing the wedge adjacent the underside of the rosette next to the finger or tooth extending through the rosette, thereby latching the horizontal to the vertical.

Figure 12:
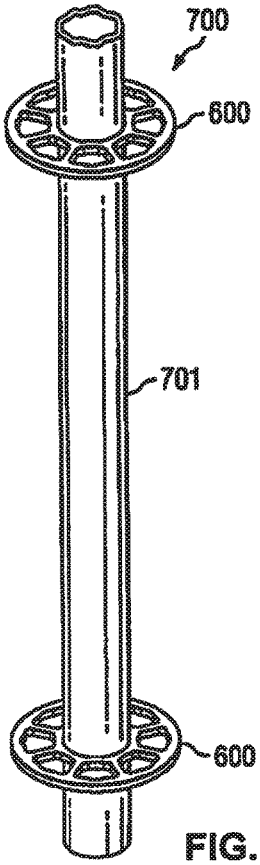
FIG. 12 is a perspective view of a vertical scaffold member with the rosettes of FIG. 11 attached

FIG. 12 is one embodiment of a vertical member 1700 of the invention having a plurality of rosettes 1600 positioned and affixed in coaxial alignment on vertical tubing 1701.

Figure 13:
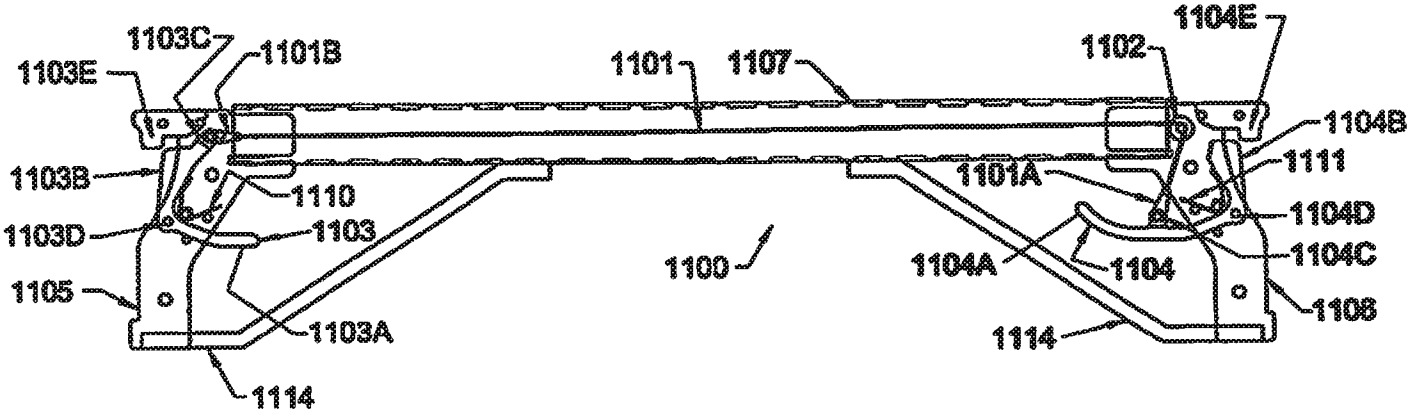
FIG. 13 is a side, partial cutaway view of one embodiment of the dual latching horizontal scaffold member in a latched or lock condition.

FIG. 13 is a side view of a second embodiment 1100 of the invention (shown with both ends of the horizontal scaffold member in the latched condition). As seen therein, a cable 1101 having a first end 1101A and a second end 1101B, couples a first handle 1103 and linkage assembly in a first wedge head 1105 at one end of a horizontal member 1107 to a second handle 1104 at the second wedge head 1106 via pulley 1102 at a second end of the horizontal member 1101. The first wedge head 1105 serves as a housing around portions of the first handle 1103 and second wedge head 1106 serves as a housing around portions of the second handle 1104.

More specifically, first handle 1103 is dimensioned as a substantially horizontal handle grip extension 1103A having a substantially vertical wedge 1103B extending in a substantially orthogonal direction due to an incurvature from the horizontal handle grip extension 1103A. Cable linkage assembly 1103C is located proximate the top of the vertical lock extension 1103B and serves as an anchor point from first handle 1103 to first end 1101B of cable 1101.

Second handle 1104 is dimensioned as a substantially horizontal handle grip extension 1104A having a substantially vertical wedge 1104B extending in a substantially orthogonal direction due to an incurvature from the horizontal handle grip extension 1104A. Cable linkage assembly 1104C is located on the top of the horizontal handle grip extension 1104A between the end of the horizontal handle grip extension 1104A and the point of curvature from the horizontal handle grip extension 1104A to vertical wedge 1104B and serves as an anchor point from second handle 1104 to second end 1101A of cable 1101.

First handle 1103 has an aperture 1103D located proximate the point of curvature between the horizontal handle grip extension 1103A and the vertical wedge 1103B, said aperture 1103D to axially receive a pin, rivet, screw or other similar structure through the first handle 1103 so as to rotatably couple the first handle 1103 through the walls of the first wedge head 1105. The coupler, can include, but is not limited to a bolt and a nut, rivet, revolute, pin and associated washers, bushings and/or bearings, each coupler being part of linkage assembly.

Second handle 1104 has an aperture 1104D located proximate the point of curvature between the horizontal handle grip extension 1104A and the vertical wedge 1104B to axially receive a pin, rivet, screw or other similar structure through the second handle 1104 so as to rotatably couple the second handle 1104 through the walls of the second wedge head 1106. The coupler, can include, but is not limited to a bolt and a nut, rivet, revolute, pin and associated washers, bushings and/or bearings, each coupler being part of linkage assembly.

In operation, teeth, fingers or prongs 1103E and 1104E couple with openings or apertures in rosettes located on opposing vertical scaffold members (such as openings 1602 shown in FIG. 11). thereby supporting the horizontal member 1100 between the two opposing vertical scaffold members. Wedge portions of the handles, 1103B and 1104B can pivot between a latched or locked position, to an unlatched or unlocked position. Springs 1110 and 1111 bias handles to the latched position, where the wedge ends 1103B and 1104B are positioned adjacent and below the rosette (when installed). In this configuration, when the horizontal member 1107 is coupled to two opposing vertical scaffold members, each tooth engages openings in the rosettes, with each tooth extending through the respective opening. One end of the respective wedge assemblies 1103B and 1104B are positioned below the respective rosette (such as near the tooth), thereby locking or trapping the horizontal member to the coupled rosette (e.g. an uplifting force on the horizontal will not disengage the horizontal from the coupled rosette).

To unlatch or unlocked a coupled wedge assembly (e.g. 1104B or 1103B), the respective wedge handle is pivoted downward or away from the horizontal member 1107, thereby compressing the respective biasing spring, and thus pivoting the respective wedge assembly (1104B or 1103B) inwardly, and away from the respective annular ring and tooth (either 1104E or 1103E), thereby allowing the respective end connector be lifted and disengaged from the rosette.

Figure 14:
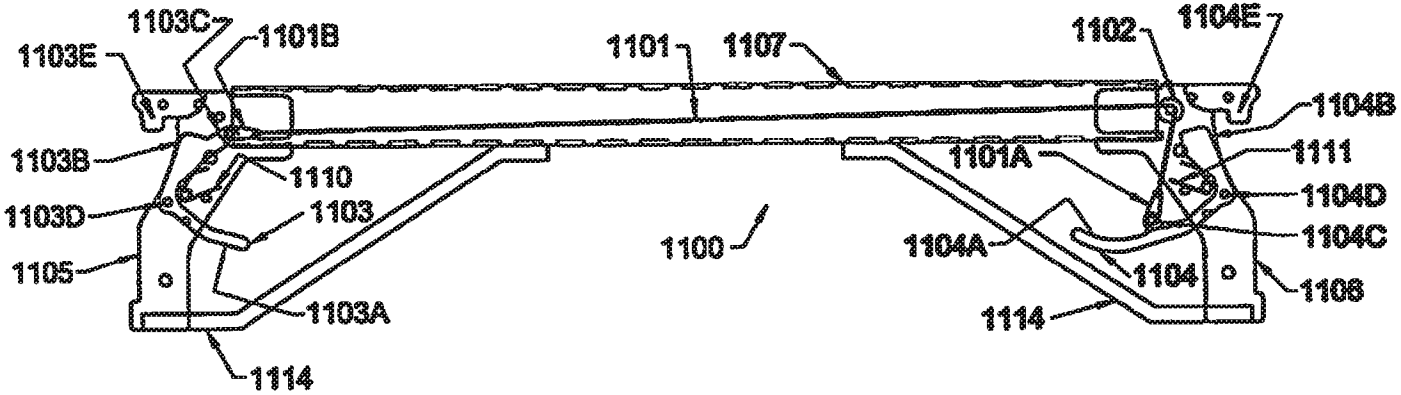
FIG. 14 is a side, partial cutaway view of the embodiment of FIG. 13, in an unlatched configuration of the primary latch.

A close inspection of FIG. 13 with FIG. 7, shows that, in each of these embodiments, the wedge assemblies and connecting cable are configured substantially identical, and hence, the embodiment of FIG. 13 will operate like the embodiment of FIG. 7 (and FIGS. 8 and 9). In the embodiment shown in FIG. 13, the end connector associated with handle 1104 corresponds to the primary latch 611*p* in FIG. 7, while the end connector associated with handle 1103 of FIG. 13, corresponds to the secondary latch 611*s* in FIG. 7. Consequently, when the primary latch handle 1104 is rotated downwardly, both wedge assemblies 1104E and 1103E will be moved from the latched position to the unlatched position, as downward motion of handle 1104 will also pull handle 1103 downwardly via cable 1101 (such as shown in FIG. 14, where the primary handled 1104 has been actuated).

However, when the secondary latch handle 1103 is rotated downwardly, only the secondary wedge assembly 1103B moves to the unlatched position—the primary wedge latch assembly 1104E remains latched, positioned below and adjacent to the coupled rosette. This action occurs as downward movement of handle 1103 does not put tension on cable, indeed, the cable will become slack, and handle 1104A will stay in the upward position (latched position) due to the bias of spring 1111.

The embodiments further include being in combination with at least one rosette attached, e.g., welded, to each vertical member. Each vertical member may have a plurality of evenly or unevenly spaced rosettes affixed, e.g., by weld, along a vertical member. The rosette has a pattern or grid of apertures designed to receive the mating elements, such as prongs at the end of a horizontal member. A wedge head may be located at the end of the horizontal member. The horizontal member is a hollow tube, preferably cylindrical in shape, having a first end and a second end. At the first end and the second end may be fixedly attached, a wedge head, as more fully described herein.

The invention further includes the method for coupling a horizontal member to a vertical member of a scaffold, comprising providing a horizontal member having a wedge head coupled to each end of the horizontal member, the wedge heads each having therein a wedge assembly partially within the wedge head, each wedge assembly pivotably coupled to its respective wedge head, each wedge assembly further comprising a handle communicably coupled via a wedge linkage assembly to a wedge, the wedge linkage assemblies being operatively coupled via a cam mechanism within the horizontal member; and disengaging either handle causing each wedge to simultaneously, partially retract into its respective wedge head. The method further includes the step of placing each wedge head on a corresponding rosette of a vertical member and engaging one of the handles so as to cause each wedge to lock the ends of the horizontal member simultaneously to the vertical members.

In an embodiment of the invention, the design of the wedge head at each end of each horizontal member keeps scaffold components square and ridged at all times utilizing predetermined angles via the grid design. The scaffold design of the invention reduces leading edge fall hazards associated with conventional scaffold systems. The scaffold design of the invention also reduces the need for hand tools during the installation and dismantling of horizontal members. Advantageously, the scaffold design of the invention reduces the amount of labor and time needed to install and dismantle a scaffold system.

The components of the invention can be fabricated from a variety of materials, including galvanized or powder coated steel, iron or other resilient material. The rosette preferably has a seven inch (7") diameter, and the internal first and second rods can comprise two square, or cylindrical rods, made of e.g., steel or iron, each having a wedge portion added or integrated at an end, the opposite ends being coupled to the crank/cam assembly. Using the grid pattern of apertures on the rosette and head having prongs dimensioned to fit therein, various angles between the horizontal members can be obtained (e.g., 45, 90, 180 degrees) for the elevated working platform.

Advantageously, the invention allows the erector to engage and disengage both wedge portions of a single horizontal member from a single point reducing installation time and creating a safer work environment. This is because the only one of the handles between the first end and the second end of the horizontal member need be actuated to engage and disengage each wedge substantially simultaneously. In this manner, up to eight (8) horizontal members can be attached to a single vertical member by a single installer without changing his position.

The invention further comprises a grid of components that mesh together creating rigid angled connection among a plurality of horizontal members at a vertical member. Both of the wedges which are part of a wedge assembly, are locked into position at the rosette on a vertical member from a single position. The internal wedge portions are locked into place by an external handle eliminating the use of any hand tools. The external handle can also be locked into place creating a secondary locking device.

The embodiments shown and described above are only exemplary. Even though numerous characteristics and advantages of embodiments of the invention have been set forth in the foregoing description together with details of the invention, the disclosure is illustrative only and changes may be made within the principles of the invention to the full extent indicated by the broad general meaning of the terms used herein. For example, the concepts described herein for coupling horizontal members to vertical members can be used to couple bracing members to vertical members or to horizontal members. Coupling includes, but is not limited to attaching, engaging, mounting, clamping, welding, bolting and components used for coupling include bolts and nuts, rivets, clevis, latches, clamps, welds, screws, rivets and the like. Further, a rosette having eight (8) radially arranged cut-outs is described herein for illustrative purposes and a rosette having more or less radially arranged cut-outs is considered to be within the scope of this invention. Also, the invention describes a rosette having a standard diameter of about seven (7) inches, however, any suitable diameter can be used. The use of a wedge head with a pair, or a wedge head with two pair, of vertical prongs is described herein for illustrative purposes and a wedge head having one or more prongs is considered within the scope of this invention. The rosette can include any suitable cut-out shape that is dimensioned to receive a corresponding prong or set of prongs of a wedge head. The vertical member can have any number of coaxially aligned rosettes attached thereto, the vertical spacing of such rosettes being any such distance as is suitable for the intended use. More generally, the invention is a scaffold system with a horizontal member, a vertical member with at least one rosette affixed in coaxial alignment to the vertical member and a wedge assembly within the horizontal member, portions of the wedge assembly for locking the horizontal member to the rosette. The vertical member has a plurality of evenly spaced rosettes affixed in coaxial alignment along the vertical member and at least one rosette has a pattern or grid of apertures designed to receive the end of the horizontal member.

To those skilled in the art to which this invention relates, many changes in construction and widely differing embodiments and applications of the invention will suggest themselves without departing from the scope of the invention as defined herein and in the appended claims. The disclosures and the descriptions herein are purely illustrative and are not intended to be in any sense limiting. The embodiments shown and described above are only exemplary. Even though numerous characteristics and advantages of embodiments of the invention have been set forth in the foregoing description together with details of the invention, the disclosure is illustrative only and changes may be made within the principles of the invention to the full extent indicated by the broad general meaning of the terms used herein. For example, the concepts described herein for coupling horizontal members to vertical members can be used to couple bracing members to vertical members or to horizontal members. Coupling includes, but is not limited to attaching, engaging, mounting, clamping, welding, bolting and components used for coupling include bolts and nuts, rivets, clevis, latches, clamps, welds, screws, rivets and the like. The vertical member can have any number of coaxially cups attached thereto, the vertical spacing of such cups being any such distance as is suitable for the intended use. The method includes a method of disconnecting both ends of a horizontal scaffold member from a vertical scaffold member.

The invention claimed is:

1. A horizontal scaffold member comprising:

a member and a primary wedge head attached to one end of the member and a secondary wedge head attached to the opposite end of the member, said primary and secondary wedge heads each having a downwardly projecting tooth or hook portion configured to couple to an annular member on a vertical scaffold member, said primary and secondary wedge heads further comprising a respective primary wedge assembly and secondary wedge assembly, each of said wedge assemblies comprising a wedge and a handle actuator partially positioned within each respective wedge head, each said wedge assembly movable by an operator in said respective wedge head from a latched to an unlatched position, by movement of said respective handle actuator, whereby in said latched position, said respective wedge is positioned adjacent said tooth or hook portion of said respective wedge head, and in said unlatched position, said respective wedge is positioned distal from said respective tooth or hook portion of said respective wedge head;

a cable connecting said primary wedge assembly to said secondary wedge assembly;

said primary wedge assembly and said secondary wedge assembly both positioned in said unlatched position when said primary wedge handle actuator is moved to position said primary wedge assembly to the unlatched position; and when said primary and secondary wedge assemblies are in said latched position, and only said secondary wedge handle actuator is moved to position said secondary wedge assembly to said unlatched position, said primary wedge assembly remains in said latched position.

2. The horizontal scaffold member of claim 1, wherein each of said wedge assemblies are separately biased to said respective latched positions.

3. The horizontal scaffold member according to claim 2, wherein each of said wedge assemblies further comprises a spring member that biases each respective said wedge assembly to a latched position.

4. The horizontal scaffold member according to claim 1, wherein said wedge head assemblies are pivotable in said wedge head.

5. The horizontal member of claim 1, wherein said tooth or hook portion is configured to couple with an upstanding annular cup positioned on a vertical scaffold member.

6. The horizontal member of claim 1, wherein said tooth or hook portion is configured to couple with openings in a rosette annular member on a vertical scaffold member.

7. The horizontal scaffold member according to claim 1, further comprising a rotatable member mounted in said primary wedge head and said cable sliding on said rotatable member when said primary wedge head assembly is moved from a latched to unlatched position.

8. The horizontal scaffold member according to claim 1, wherein each of said wedge heads further comprises a second tooth or second hook portion coupleable with an annular member on a vertical scaffold member.

9. The horizontal scaffold member according to claim 1, wherein said cable is attached to said secondary wedge head assembly at said wedge of said secondary wedge head assembly, and wherein said cable is attached to said primary wedge head assembly at said handle actuator of said primary wedge head assembly.

10. The horizontal scaffold member according to claim 8, wherein said primary handle actuator is shaped differently from said secondary handle, to allow an operator to visually distinguish between the primary and secondary handle actuators.

11. The horizontal scaffold member of claim 8 wherein said cable is a wire rope.

* * * * *